US011084507B2

(12) United States Patent
Winsor

(10) Patent No.: US 11,084,507 B2
(45) Date of Patent: Aug. 10, 2021

(54) ANTI-THEFT DEVICE FOR A TRANSPORT RAILCAR GRATING

(71) Applicant: Holden America IL, LLC, Chicago, IL (US)

(72) Inventor: Robert B. Winsor, Montreal (CA)

(73) Assignee: Holden America IL, LLC, Chicago, IL (US)

( * ) Notice: Subject to any disclaimer, the term of this patent is extended or adjusted under 35 U.S.C. 154(b) by 663 days.

(21) Appl. No.: 15/874,046

(22) Filed: Jan. 18, 2018

(65) Prior Publication Data

US 2018/0201277 A1 Jul. 19, 2018

Related U.S. Application Data

(60) Provisional application No. 62/447,574, filed on Jan. 18, 2017, provisional application No. 62/447,566, filed on Jan. 18, 2017.

(51) Int. Cl.
*B61D 3/18* (2006.01)

(52) U.S. Cl.
CPC ..... *B61D 3/187* (2013.01)

(58) Field of Classification Search
CPC ..... B61D 45/001; B61D 17/10; B61D 3/187; E03F 5/06; E02D 29/124
See application file for complete search history.

(56) References Cited

U.S. PATENT DOCUMENTS 4,136,598 A * 1/1979 Hughes ..... F16B 37/14 411/372
4,883,394 A * 11/1989 Van der Woude .... E02D 29/124 411/51
5,039,263 A * 8/1991 Meyer ..... E02D 29/14 411/51
5,302,063 A * 4/1994 Winsor ..... B60P 3/077 188/32
5,975,818 A * 11/1999 Burke ..... B61D 3/187 248/357
2016/0214624 A1* 7/2016 Boudreau ..... B61D 17/10

FOREIGN PATENT DOCUMENTS

JP 2001279800 A * 10/2001 ..... E03F 5/06
JP 2009097311 A * 5/2009 ..... E03F 5/06

* cited by examiner

*Primary Examiner* — Scott A Browne
(74) *Attorney, Agent, or Firm* — Ice Miller LLP

(57) ABSTRACT

A security device, such as an anti-theft device, for a transport vehicle, such as a railcar, grating hinge connector includes a plate and a cup. The hinge connector has a first portion secured to the deck surface by a fastener with a head, and a second portion coupled to the grating. The cup has a base and a wall forming a cavity sized and shaped to receive the plate. The wall forms an opening that is sized and shaped to receive the plate for insertion into the cavity. The base is positioned on the hinge connector and has another opening sized and shaped to receive the fastener with the head positioned in the cavity. The insertion of the plate in the cavity secures the head of the fastener within the anti-theft device.

8 Claims, 10 Drawing Sheets

ANTI-THEFT DEVICE FOR A TRANSPORT RAILCAR GRATING

This application claims the benefit of U.S. Provisional Application No. 62/447,574, filed on Jan. 18, 2017, and U.S. Provisional Application No. 62/447,566, filed on Jan. 18, 2017, each of which is hereby incorporated by reference in its entirety.

BACKGROUND OF INVENTION

The present invention relates to transport vehicles with grating decks, and in particular, to security devices, such as an anti-theft device, for securing the grating to the transport vehicle, such as a railcar.

Transport railcars, such as multi-deck railroad flatbeds for transporting road vehicles, commonly have a support surface or deck formed by a grating of steel rods coupled to the deck surface. The panels are secured to the transport railcar by a grating connector, such as a hinge connector that permits the grating to be raised and tilted to facilitate the removal of debris from the deck surface. An example of a grating hinge connector is described in U.S. Pat. No. 5,312,213 to Winsor, which is incorporated herein by reference.

The gratings of transport railcars are frequently subject to theft as fencing material, concrete reinforcement, or scrap metal. Theft can be a particular problem in the railroad industry, where railcars are often stored on track sidings with little security. Bi-level auto-rack railcars may have as many as 28 grating panels that are about 12½ feet long and weigh about 75 pounds, or a total of about one ton of scrap metal. Consequently, railcar gratings can be an attractive target for thieves.

The grating connector is commonly fastened to the transport railcar by blind rivet fasteners such as the dome head steel body steel mandrel type. These fasteners have a top or head that lays flat against the transport railcar or grating connector surface. Thieves typically remove these fasteners by drilling into the head of the fasteners or otherwise break them off by wedging under the grating connector with a chisel. Thus, it would be desirable to provide an anti-theft device that increases the difficulty of removing the grating connector from the deck surface—e.g., by providing additional protection for the heads of the fasteners.

SUMMARY OF THE INVENTION

In an embodiment of the invention, an anti-theft device for a transport railcar grating is disclosed, where the grating is coupled to a surface of the railcar by a fastener having a head and a shank. The security device comprises a cup including a base and a wall, where the base and wall define a cavity. The base having a first opening that is sized and shaped to receive the shank of the fastener and retain the head within the cavity.

In another embodiment of the invention, an anti-theft device for a transport railcar grating is disclosed, where the grating includes a plurality of transversely coupled rods that form a plurality of grating openings therebetween. The grating is coupled to a surface of the railcar by a grating connector. The anti-theft device comprising a body that extends over the grating connector. The body includes a first end coupled to a surface of the railcar and a second end projecting through a grating opening. The second end further including a flange extending transversely to a rod forming the grating opening.

In another embodiment of the invention, an anti-theft device for a transport railcar grating is disclosed, where the grating includes a plurality of transversely coupled rods that form a plurality of grating openings therebetween. The grating is coupled to a surface of the railcar by a grating connector. The anti-theft device comprising a fastener and a body that extends over the grating connector. The body comprising a first end coupled to the railcar surface by the fastener. The first end including a base and a wall that define a cavity, where the base includes a first opening sized and shaped to receive the fastener. The wall having an outer surface including at least one side that forms an obtuse angle relative to the railcar surface. The body further comprising a second end that projects through a grating opening and includes a flange extending transversely to a rod forming the grating opening.

DETAILED DESCRIPTION OF THE INVENTION

Figure 1A:
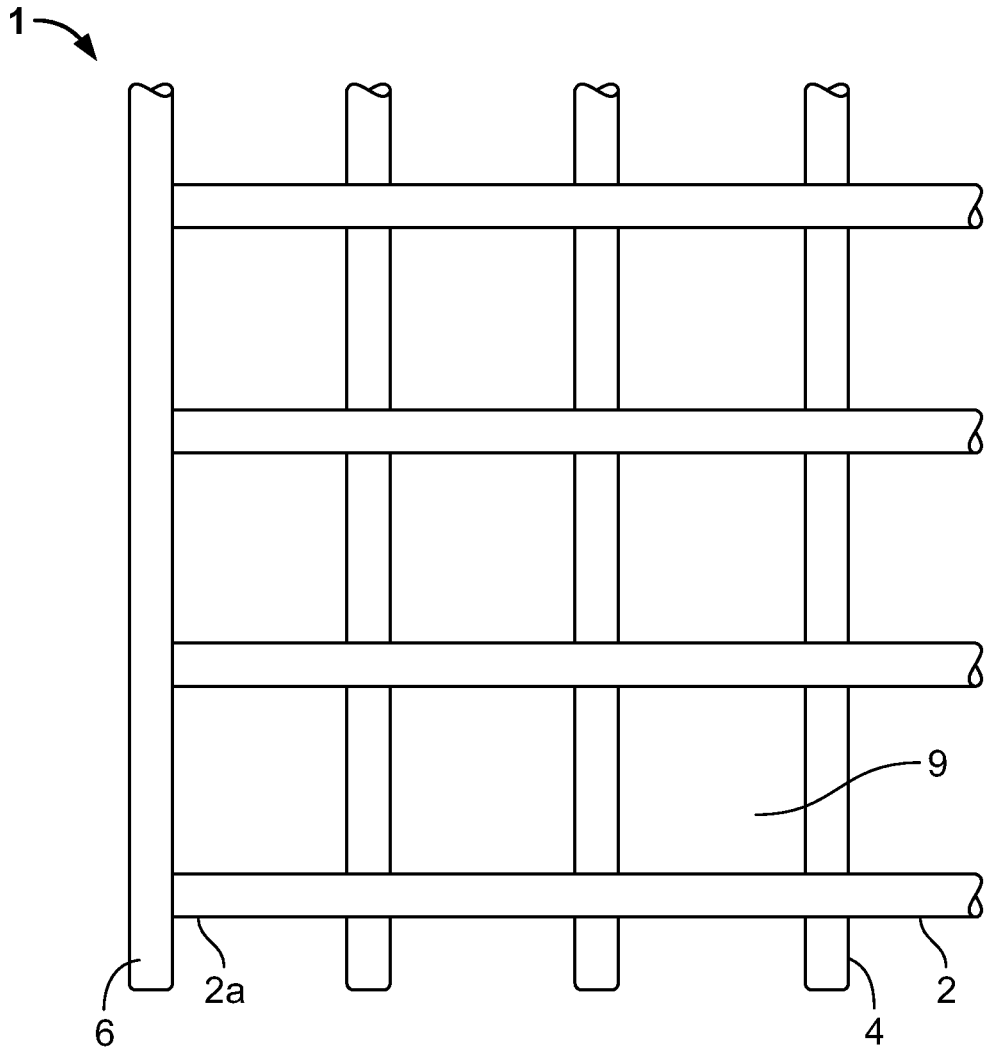
FIG. 1A is a top view of a grating for a transport railcar.
Figure 1B:
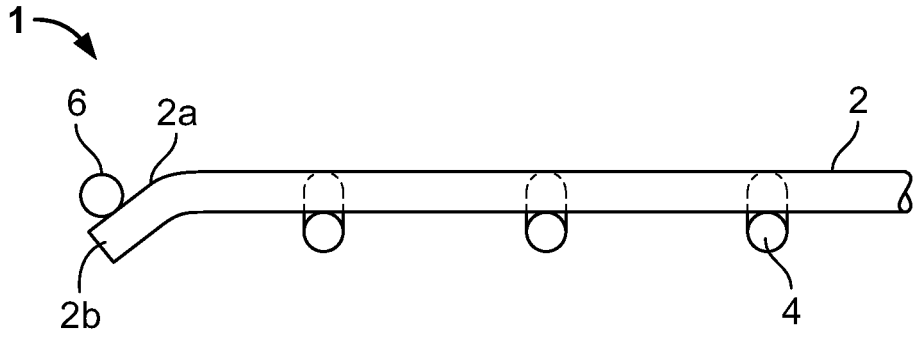
FIG. 1B is a side section view of the grating of FIG. 1A.

Referring now to the drawings, a security device, such as an anti-theft device, for a grating hinge connector is shown. FIGS. 1A and 1B show a portion of a conventional grating panel 1—e.g., as used for a transport vehicle, such as a railcar deck. Grating panel 1 is comprised of transversely coupled top rods 2 and bottom undulated rods 4, that are arranged to form a rectangular deck grating section or panel. The transversely coupled top rods 2 and bottom rods 4 form a plurality of grating openings 9 therebetween. The end portions 2*a* of top rods 2 are typically bent at an edge or end of the grating panel. A hinge rod or bar 6 is coupled to the end portions 2*a*, adjacent to the free ends 2*b* of top rods 2. The rods 2 and 4, and hinge bar 6 are typically cylindrical steel rods that are welded together.

Figure 2:
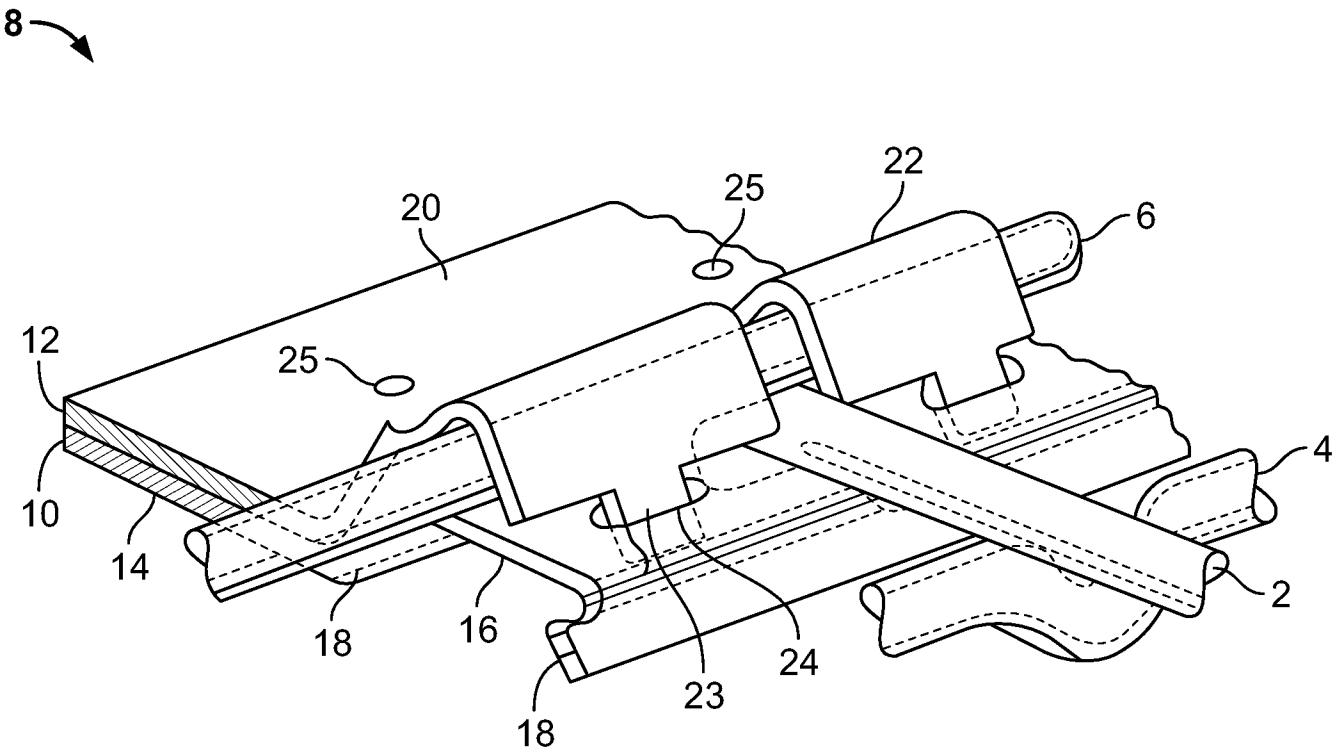
FIG. 2 is an orthographic view of the grating of FIG. 1A engaged in a grating connector.

FIG. 2 shows a grating connector such as a conventional hinge connector having a first end secured to the deck surface of a transport railcar and a second end coupled to the hinge bar 6 of a grating panel. Grating hinge connector 8 comprises a hinge base 10 and a hinge keeper 12. Hinge base 10 comprises a base seat 14 and platform 16. Base seat 14 is generally positioned on the railcar surface, such as a deck surface 40. In one embodiment, hinge base seat 14 generally conforms to the configuration of the transport railcar deck surface 40. Platform 16 is raised above the transport railcar surface by legs 18. When grating panel 1 is engaged in hinge connector 8, hinge bar 6 may rest on and is supported by platform 16. One or more slots or notches 17 (FIG. 3A) are formed in platform 16 that are sized and shaped to accommodate the top rod 2 and/or the top rod end portions 2*a* that extend below hinge bar 6.

Hinge keeper 12 comprises a keeper seat 20 and an arched hinge bar cover 22. Keeper seat 20 is positioned on top of base seat 14 of hinge base 10. In a preferred embodiment, keeper seat 20 is sized and shaped to rest on and generally conform to the configuration of base seat 14 of hinge base 10. Hinge bar cover 22 is sized and shaped to extend over hinge bar 6 and at least a portion of platform 16 of hinge base 10, such that the hinge bar 6 is disposed between the hinge bar cover 22 and the platform 16. One or more tabs 23 are formed at the end of hinge bar cover 22. Slots 24 are formed in platform 16 of hinge base 10 that are sized and shaped to receive tabs 23 of the hinge bar cover 22. The engagement of the hinge bar cover tabs 23 in slots 24 assists in securing hinge keeper 12 to hinge base 10.

Hinge base 10 and hinge keeper 12 may be formed as elongated flat strips or slats. In an embodiment, hinge base 10 and hinge keeper 12 are formed of sheet metal, such as sheet steel, that is bent into the appropriate shape using any of a variety of sheet metal bending methods known in the art. In another embodiment, hinge base 10 and hinge keeper 12 are formed as a single, contiguous piece of material. In an alternative embodiment, hinge base 10 and hinge keeper 12 are formed as a plurality of pieces.

Hinge connector 8 is commonly secured to a railcar deck surface by any of a variety of fasteners known in the art, including screws, rivets and bolts, such as a Huck Magna-Lok® (Alcoa Fastening Systems & Rings—Waco, Tex.). Openings 25 are provided in base seat 14 and keeper seat 20, that are aligned and sized and shaped to receive the fasteners and secure hinge connector 8 to the railcar deck surface 40.

Hinge base 10 and hinge keeper 12 are assembled such that hinge bar 6 is disposed between the hinge bar cover 22 and platform 16, permitting grating panel 1 to rotate about its hinge bar 6 upwardly off of a transport railcar deck surface. Accordingly, legs 18 of platform 16 preferably raise the platform 16 above the transport railcar surface a distance sufficient to prevent end portions 2*a* of the grating panel 1 top rods 2 from contacting the transport railcar surface in a manner that prevents rotation of grating panel 1. When grating panel 1 is in an upward position, it is easy for snow and debris to be cleaned away from under grating panel 1 that has accumulated on the deck surface 40. Additionally, ice and snow or other debris clinging to grating panel 1 can be removed by impacting grating panel 1 on the railcar's deck surface.

Figure 3A:
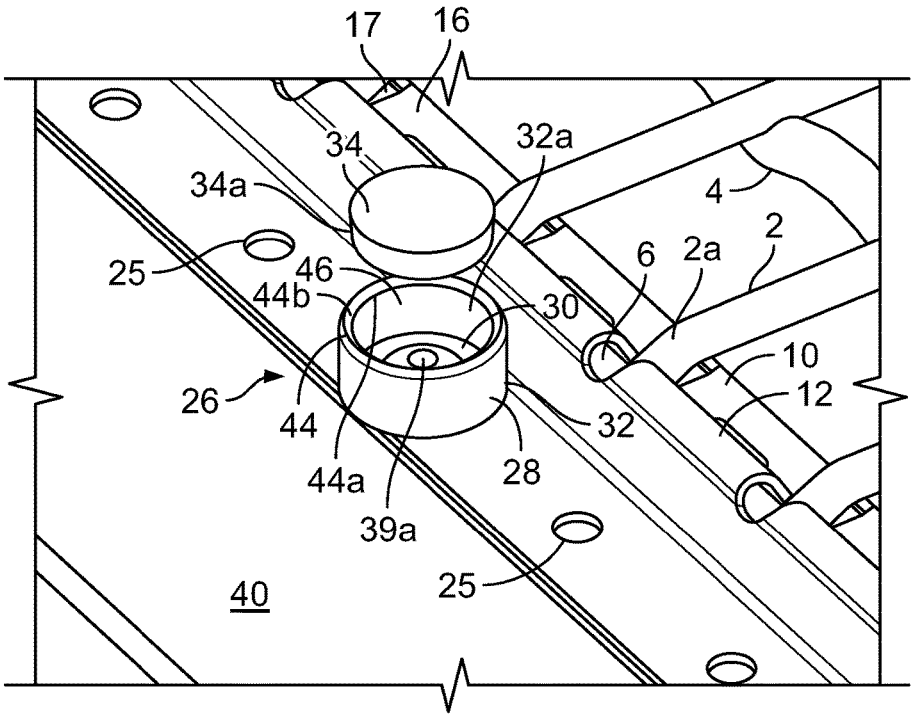
FIG. 3A is an orthographic view of an anti-theft device coupled to the grating connector and grating of FIG. 2.

Referring to FIGS. 3A-3D, a cup-block anti-theft device 26 for a grating hinge connector 8 is shown, comprising a cup 28 and a plate 34 that enclose and protect the head 39*a* of a hinge connector fastener 38. Cup 28 and plate 34 may be of various shapes and sizes, so long as plate 34 can fit into cup 28. In one embodiment, plate 34 is approximately disc-shaped as shown in FIG. 3A. Cup 28 comprises a base 30 and wall 32 that form an interior cavity 46 that is sized and shaped to receive plate 34.

Cup 28 is positioned on hinge connector 8, with base 30 resting on keeper seat 20. Base 30 is preferably sized and shaped to conform to keeper seat 20, to minimize any space between cup-block anti-theft device 26 and hinge connector 8 that may allow access to fastener 38, or the insertion of a tool to pry the anti-theft device from the hinge connector. Base 30 may also be configured to accommodate or conform to other features of hinge connector 8 and/or railcar deck surface 40. For example, base 30 may be sheared or angled to form a bevel 31 that allows cup-block anti-theft device 26 to be positioned more closely to arched hinge bar cover 22 and/or to accommodate a larger sized anti-theft device.

An opening 35 is formed in base 30 that is sized and shaped to receive a hinge connector fastener 38 having a head 39*a* and a shank 39*b* that extends from the head 39*a* to the end point of the fastener 38, to secure cup-block anti-theft device 26 and hinge connector 8 to a transport railcar deck surface 40. In one embodiment, opening 35 has approximately the same size and shape as opening 25*a* formed in base seat 14 and opening 25*b* formed in keeper seat 20. In an alternative embodiment, opening 35 and/or shank 39*b* is larger than openings 25*a* and 25*b*. In this embodiment, openings 25*a* and 25*b* may be enlarged by means known in the art, such as drilling, to match the size of opening 35 and/or to receive shank 39*b*. Fastener 38 is inserted through opening 35 in base 30, opening 25*a* in base seat 14, and opening 25*b* in keeper seat 20, and through railcar deck surface 40. More particularly, the shank 39*b* extends through opening 35 in base 30, opening 25*a* in base seat 14, opening 25*b* in keeper seat 20, and through railcar deck surface 40. The head 39*a* of fastener 38 is sized and shaped to be retained in cavity 46 and to secure hinge connector 8 and cup-block anti-theft device 26 to railcar deck surface 40. In one embodiment, the head 39*a* is larger than opening 35 in base 30 such that head 39*a* will not fit through opening 35 in base 30.

Wall 32 may be of various sizes and shapes that are sufficient to form a cavity 46 large enough to contain both plate 34 and head 39*a* of fastener 38. In one embodiment, wall 32 may be cylindrical and base 30 may be circular, such that the wall and base form a cylindrical cup 28. The height of wall 32 may also vary. In an embodiment, wall 32 has a height above keeper seat 20 that is about the same or less than the height of arched hinge bar cover 22 and/or top rods 2, to avoid creating a tripping hazard. In another embodiment, wall 32 has a height above the keeper seat 20 that is greater than the height of the fastener head 39*a* that is retained in the cavity 46.

Figure 3B:
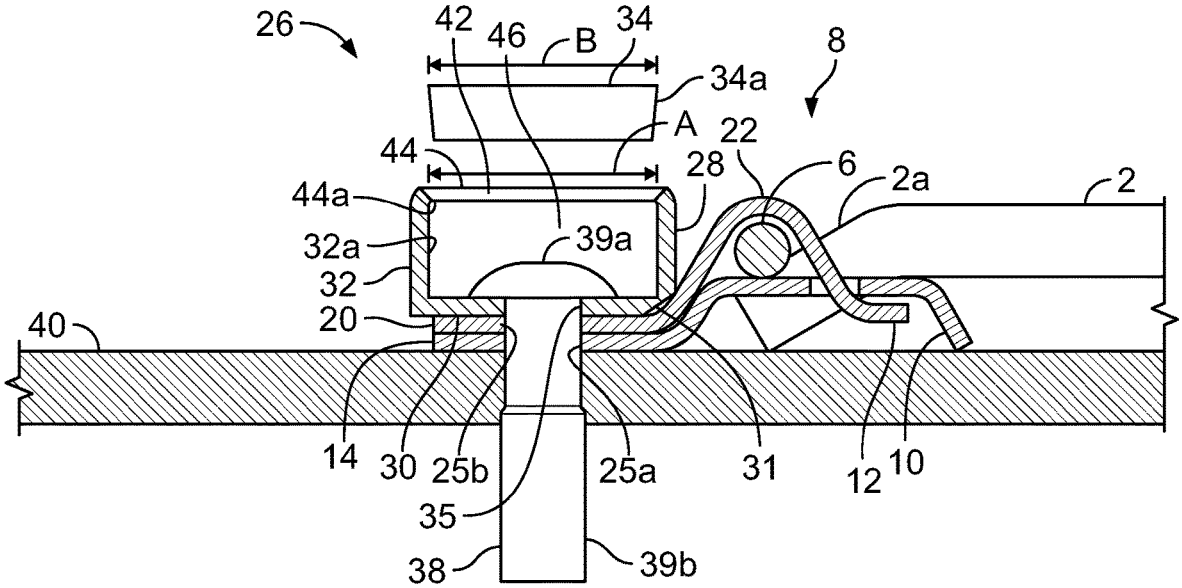
FIG. 3B is a side section view of the anti-theft device of FIG. 3A.
Figure 3C:
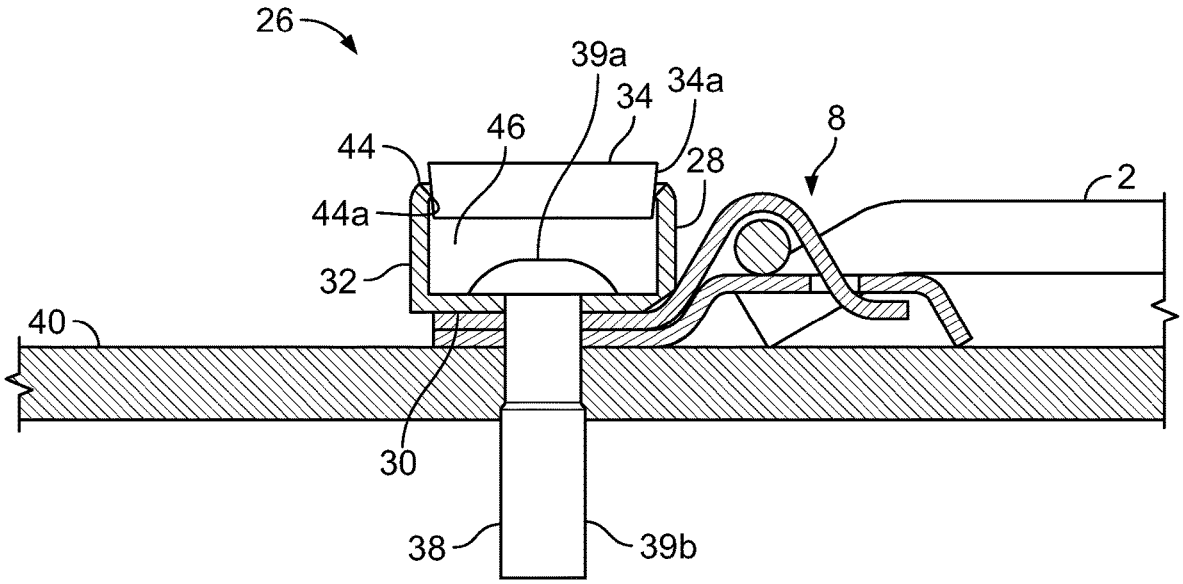
FIG. 3C is a side section view of the anti-theft device of FIG. 3A, showing the partial assembly of the anti-theft device.
Figure 3D:
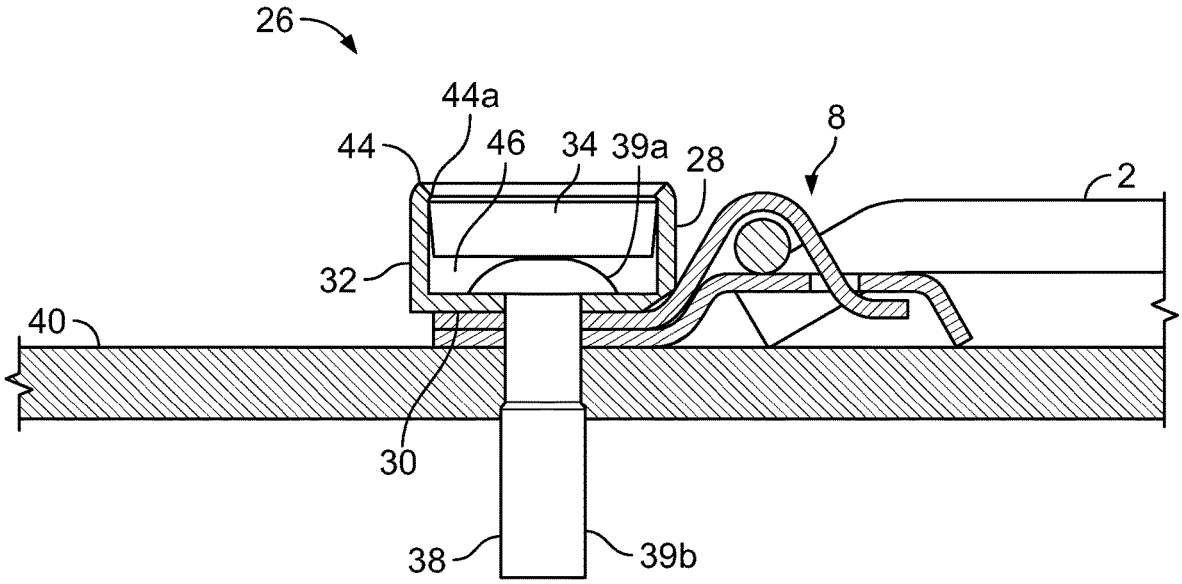
FIG. 3D is a side section view of the anti-theft device of FIG. 3A, showing the fully assembled anti-theft device.

In one embodiment, cup-block anti-theft device 26 is assembled by snap fit insertion of plate 34 into cavity 46 of cup 28, as shown in FIGS. 3B-3D. Wall 32 has a rim 44 that defines an opening 42 into cavity 46. Rim 44 has an inner edge 44*a* that forms a lip having a width or diameter A that is slightly smaller than maximum width or diameter B of plate 34. Wall 32 has an inner surface 32*a* that forms a cavity 46 having a width or diameter that is slightly larger than diameter B of plate 34, such that inner edge 44*a* forms the lip.

FIG. 3C shows plate 34 partially inserted through opening 42, with the sides 34*a* of the plate extending around the perimeter of the plate and engaging the inner edge 44*a* of rim 44. Rim 44 of cup 28 and/or the sides 34*a* of plate 34 may be at least partially beveled to facilitate insertion of the plate through opening 42 and into cavity 46. For example, rim 44 of cup 28 may have a bevel 44*b* and/or plate 34 may be a disc having a conical (frustum) shape, as best shown in FIG. 3A.

Plate 34 is forced through the smaller diameter A of inner edge 44*a* of rim 44—e.g., by hammering. As plate 34 is forced through opening 42, the lip of inner edge 44*a* and/or wall 32 flex to accommodate the larger diameter B of the plate. Once plate 34 passes through opening 42 and is fully inserted into cavity 46, the lip of inner edge 44*a* returns to its original configuration as shown in FIG. 3D. Because the diameter A of inner edge 44*a* is smaller than the diameter B of plate 34, the plate is trapped within cavity 46 by the lip of rim 44.

The insertion of plate 34 into cavity 46 encloses head 39*a* of fastener 38 within cup 28, to prevent access to the head from the sides by a tool such as a nail puller or similar device. Plate 34 covers head 39*a* of fastener 38 to protect the top of the head from a drill or other device. Cavity 46 may have a width or diameter that is slightly larger than diameter B of plate 34, which allows plate 34 to freely rotate and/or provides some degree of tilt within the cavity. The free rotation and tilt of plate 34 increases the difficulty in drilling through the plate to reach the head 39*a* of the fastener 38, by causing the drill bit to slip or engage the plate off-axis.

In a preferred embodiment, the shape of opening 42 and cavity 46 generally conform to the shape of plate 34 to minimize any space that may allow insertion of a tool to pry or remove the plate from the cavity. In a further embodiment, the height of cavity 46 is about the same as or slightly greater than the combined height of plate 34 and head 39*a* of fastener 38, to firmly secure the head within cup-block anti-theft device 26 and further minimize any space that would allow insertion of a tool into the cavity.

In an alternative embodiment, cup-block anti-theft device 26 may be assembled by friction fit insertion of plate 34 within cavity 46. The width or diameter of cavity 46 may be slightly smaller than the diameter B of plate 34. Plate 34 is hammered or otherwise forced into cavity 46 until it engages head 39*a* of fastener 38, and is secured within the cavity by friction fit.

Cup 28 and/or plate 34 are preferably made of hardened steel, such as Hardox® steel (SSAB, Sweden). However, other types of steel and metal alloys may be used, as are known in the art.

The anti-theft device may be further configured to increase the difficulty in removing the fastener by brute force—e.g., by dislodging the anti-theft device and fastener using a sledge hammer. FIGS. 4A-4D show another embodiment of an anti-theft device 126, having a wall 132 that is configured to deflect the blows of a sledge hammer or other device. Anti-theft device 126 comprises a plate 134 and cup 128 that are generally configured as described above, for insertion of the plate into the cup to enclose the head 39*a* of a fastener 38. For example, plate 134 may be disc-shaped with a partially beveled side 134*a*. Cup 128 comprises a base 130 and a wall 132 that form a cavity 146. Base 130 has an opening 135 that is sized and shaped to receive fastener 38 with head 39*a* retained in cavity 146. Wall 132 has a beveled rim 144 that defines an opening 142 into cavity 146. Rim 144 has an inner edge 144*a* that forms a lip having a width or diameter that is slightly smaller than the maximum width or diameter of plate 134. Wall 132 has an inner surface 132*a* that forms a cavity 146 having a width or diameter that is slightly larger than the width or diameter of plate 134, such that inner edge 144*a* forms the lip.

Figure 4A:
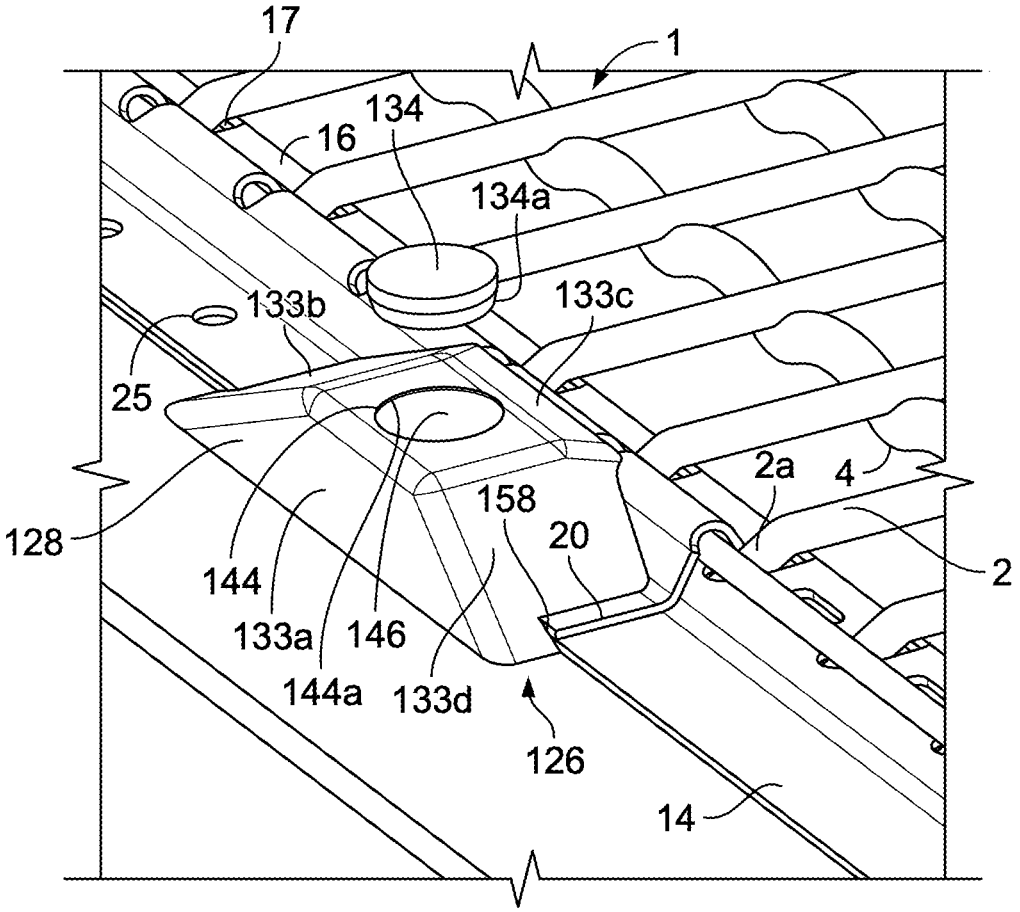
FIG. 4A is an orthographic view of an alternative embodiment of an anti-theft device coupled to the grating connector and grating of FIG. 2.
Figure 4B:
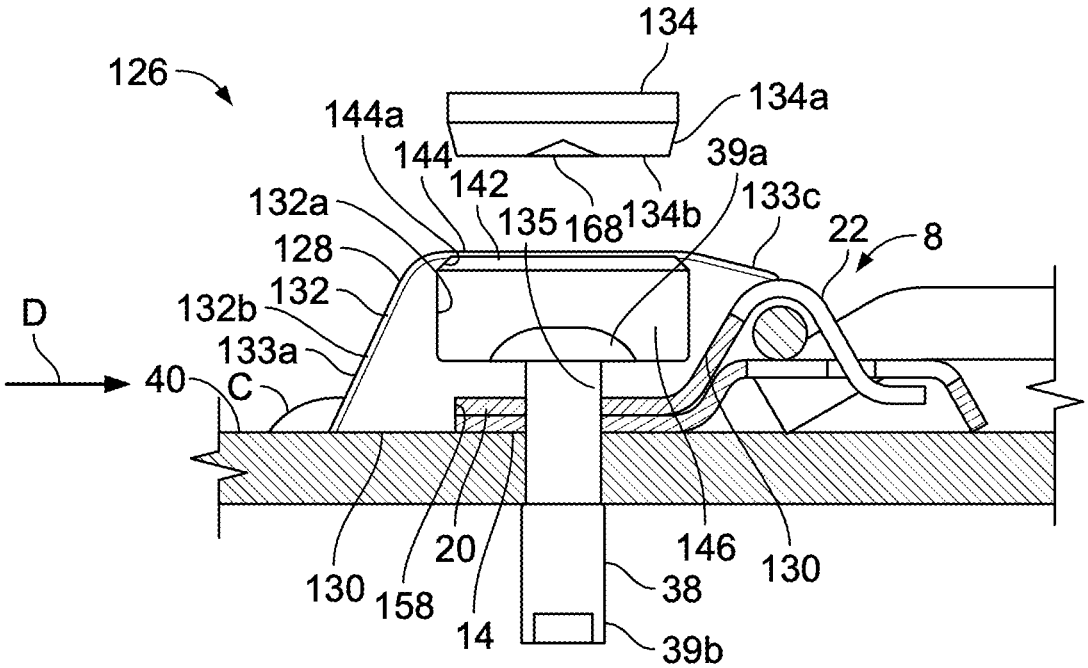
FIG. 4B is side section view of the anti-theft device of FIG. 4A.
Figure 4C:
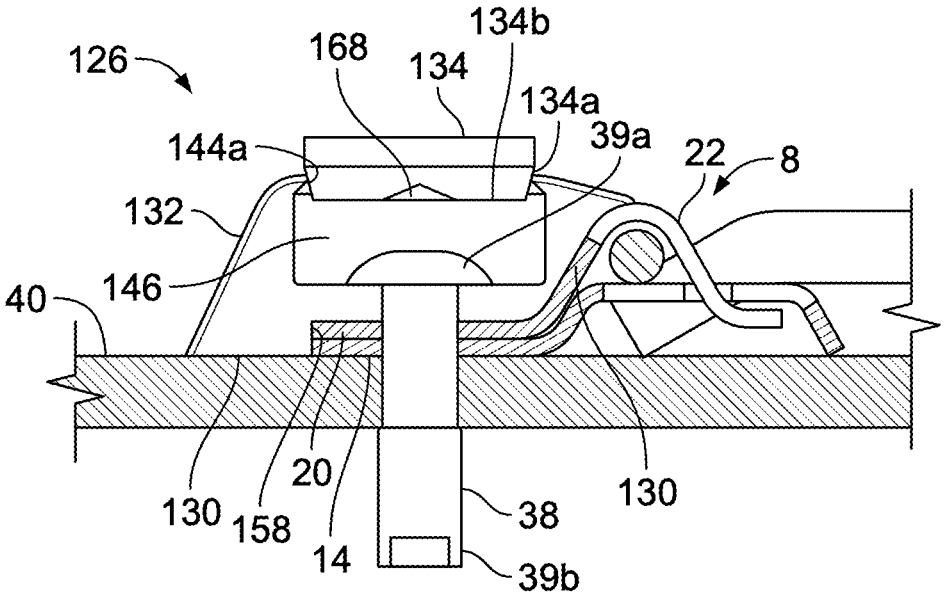
FIG. 4C is a side section view of the anti-theft device of FIG. 4A, showing the partial assembly of the anti-theft device.
Figure 4D:
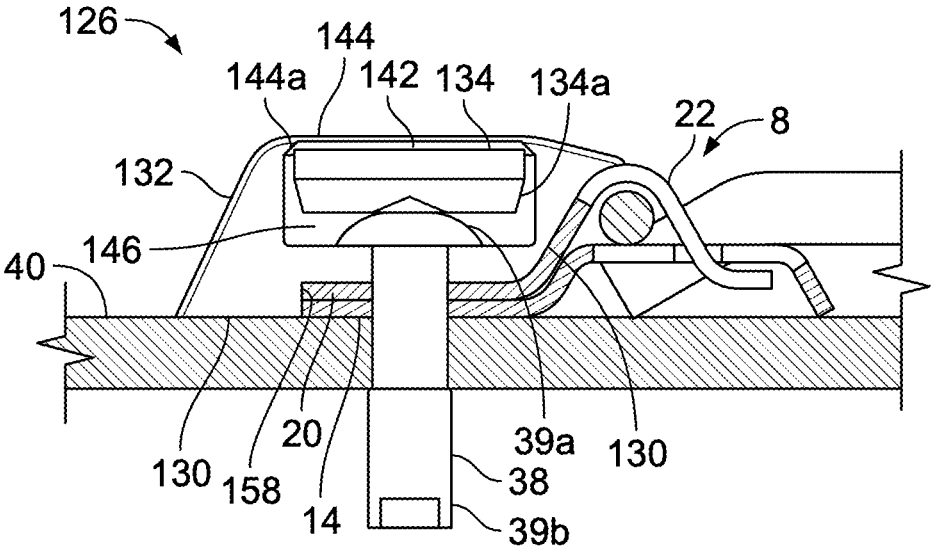
FIG. 4D is a side section view of the anti-theft device of FIG. 4A, showing the fully assembled anti-theft device.

FIGS. 4C and 4D show the snap fit insertion of plate 134 into cavity 146 of cup 128. FIG. 4C is similar to FIG. 3C, and shows plate 134 partially inserted through opening 142, with the sides 134*a* of the plate engaging the inner edge 144*a* of rim 144. FIG. 4D is similar to FIG. 3D, and shows plate 134 fully inserted through opening 142 and trapped within cavity 146 by the lip of rim 144.

Cup 128 is configured to deflect the impact of a blow to the side of anti-theft device 126. Wall 132 has an outer surface 132*b* where at least a portion of the outer surface forms an obtuse angle C with railcar deck surface 40. Any blow or force applied to angled outer surface 132*b* along a horizontal plane (e.g., as shown by arrow D) will be a glancing blow having reduced effectiveness. In one embodiment, cup 128 has a pyramidal shape—e.g., having an outer surface 132*b* with four sides 133*a*, 133*b*, 133*c* and 133*d* that form a truncated square pyramid, as shown in FIG. 4A. Sides 133*a*, 133*b*, 133*c* and 133*d* may form the same or different obtuse angles with railcar deck surface 40. For example, side 133*c* adjacent to hinge bar cover 22 of hinge connector 8 may form a shallower angle than sides 133*a*, 133*b* and/or 133*d*. The shallow angle of side 133*c* minimizes the transition between cup 128 and the hinge bar cover and reduces the tripping hazard. Those of skill in the art will appreciate that cup 128 may have other configurations where at least a portion of the outer surface 132*b* forms an obtuse angle with railcar deck surface 40—e.g., a truncated conical shape, truncated tetrahedron, or a wedge shape.

It will also be apparent to those of skill in the art that the size of base 130 will generally increase as the angle of outer surface 132*b* becomes shallower. Although base 130 is positioned on keeper seat 20, it may also extend over a portion of railcar deck surface 40 and/or other portions of hinge connector 8, such as hinge bar cover 22. As described above, base 130 is preferably configured to conform to the keeper seat and other features of hinge connector 8 and/or the portion of railcar deck surface 40 over which it extends. For example, a notch 158 may be formed in the base that is sized and shaped to conform to the ends of keeper seat 20 and base seat 14 and/or base 130 may conform to the slope of arched hinge bar cover 22, as best shown in FIG. 4A. The larger area of base 130 increases the difficulty in accessing fastener 38 and assists in securing hinge connector 8 to railcar deck surface 40.

Figure 4E:
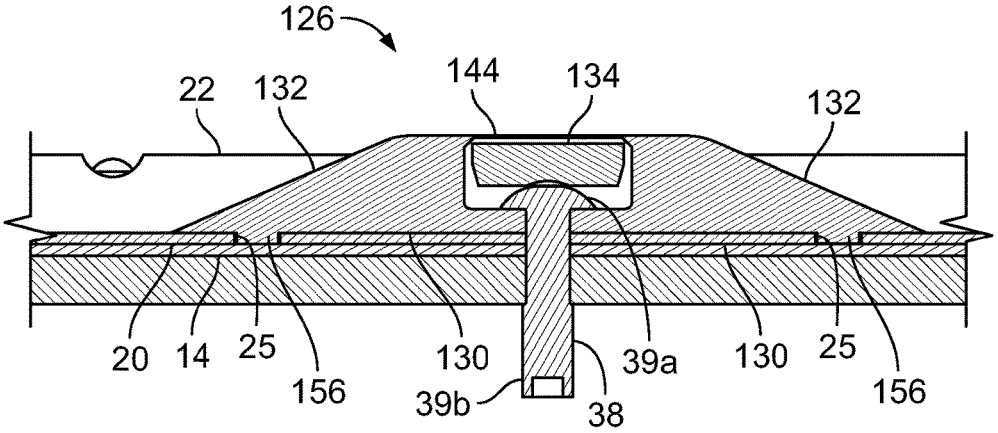
FIG. 4E is a front section view of anti-theft device of FIG. 4A.

In a further embodiment, base 130 may extend over one or more openings 25 that are provided in keeper seat 20 of hinge connector 8 to receive additional fasteners 38. As shown in FIG. 4E, tabs 156 may be formed in base 130 that are positioned to align with and are sized and shaped to be received in openings 25. The engagement of tabs 156 in openings 25 further secures anti-theft device 126 to railcar deck surface 40 and/or keeper seat 20 and increases the difficulty in removing fastener 38 by force.

In yet another embodiment, plate 134 may be formed with an indentation or notch 168 in the bottom surface 134*b* of the plate, positioned adjacent to the head 39*a* of fastener 38. For example, notch 168 may be formed as a conical indentation in the surface 134*b* of plate 134. Notch 168 assists in centering plate 134 over the rounded head 39*a* of fastener 38 and also reduces the combined height of plate 134 and head 39*a*. In addition, notch 168 facilitates the rotation and/or tilting of the plate about the head of the fastener. Those of skill in the art will appreciate that notch may have other shapes, such as a dome shape.

Referring to FIGS. 5A-5D, another embodiment of an anti-theft device is shown coupled to hinge connector 8. Overhinge anti-theft device 50 comprises a body 52 that is sized and shaped to extend over hinge connector 8. Body 52 has a first end 52*a* and a second end 52*b*. First end 52*a* is positioned on the transport railcar deck surface 40, and preferably conforms to the configuration of the railcar deck surface. Second end 52*b* comprises a seat 54 and arched cover 56 that extend over hinge connector 8. Anti-theft device seat 54 is sized and shaped to extend over keeper seat 20 (and base seat 14) of hinge connector 8. Anti-theft device arched cover 56 is sized and shaped to extend over hinge bar cover 22, and preferably over at least a portion of platform 16.

In one embodiment, anti-theft device seat 54 and/or arched cover 56 are respectively sized and shaped to conform to the configuration of keeper seat 20 and hinge bar cover 22. This configuration minimizes the space between hinge connector 8 and overhinge anti-theft device 50—e.g., that may allow room for the hinge connector to be pried away from the railcar deck surface, or to insert a tool between the hinge connector and anti-theft device to pry them apart.

Figure 5A:
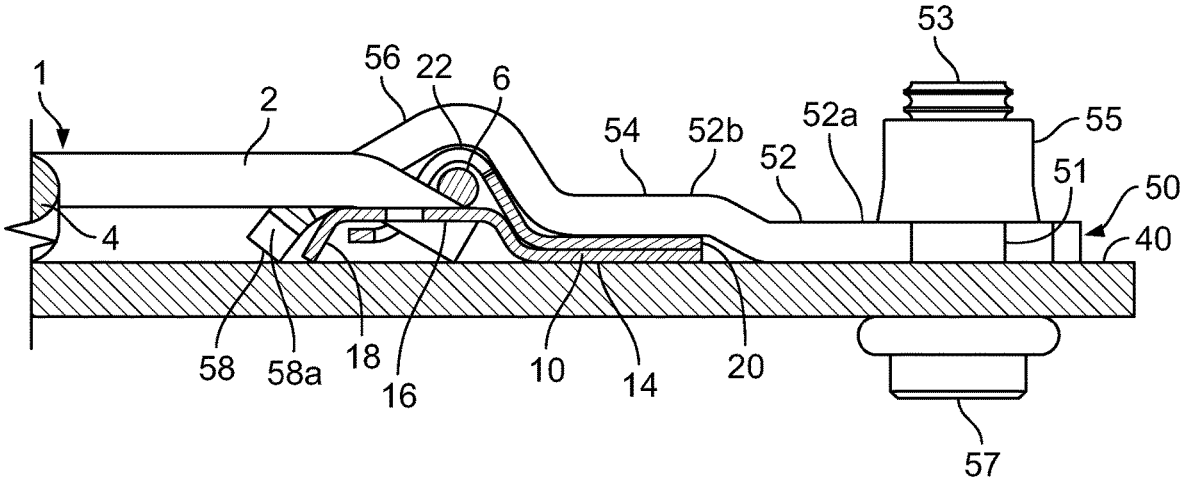
FIG. 5A is a side section view of an alternative embodiment of an anti-theft device coupled to the grating connector and grating of FIG. 2.
Figure 5B:
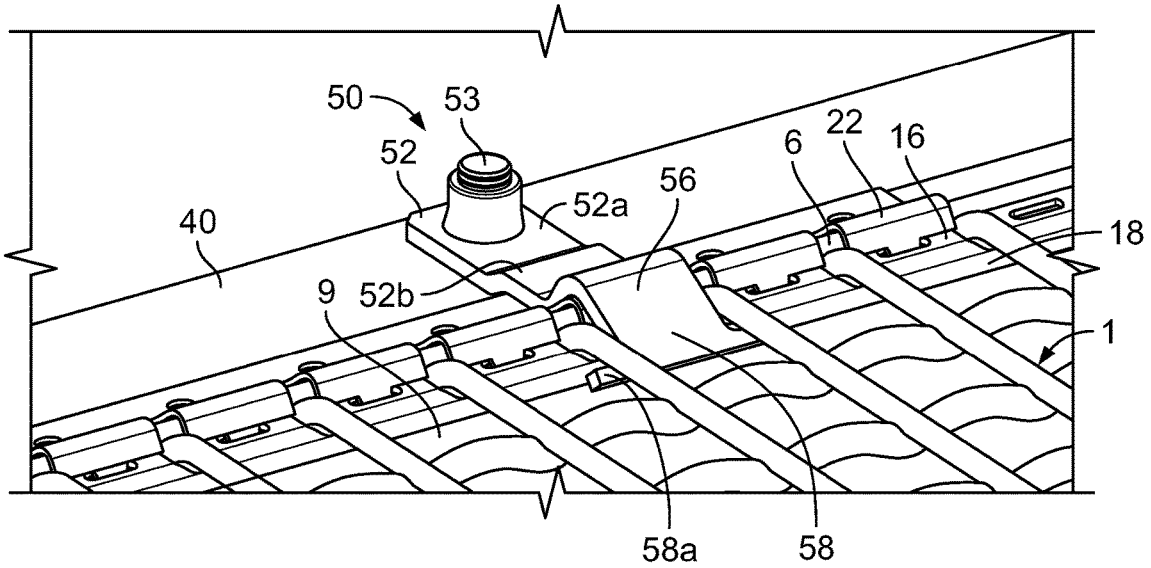
FIG. 5B is an orthographic view of the anti-theft device of FIG. 5A.
Figure 5C:
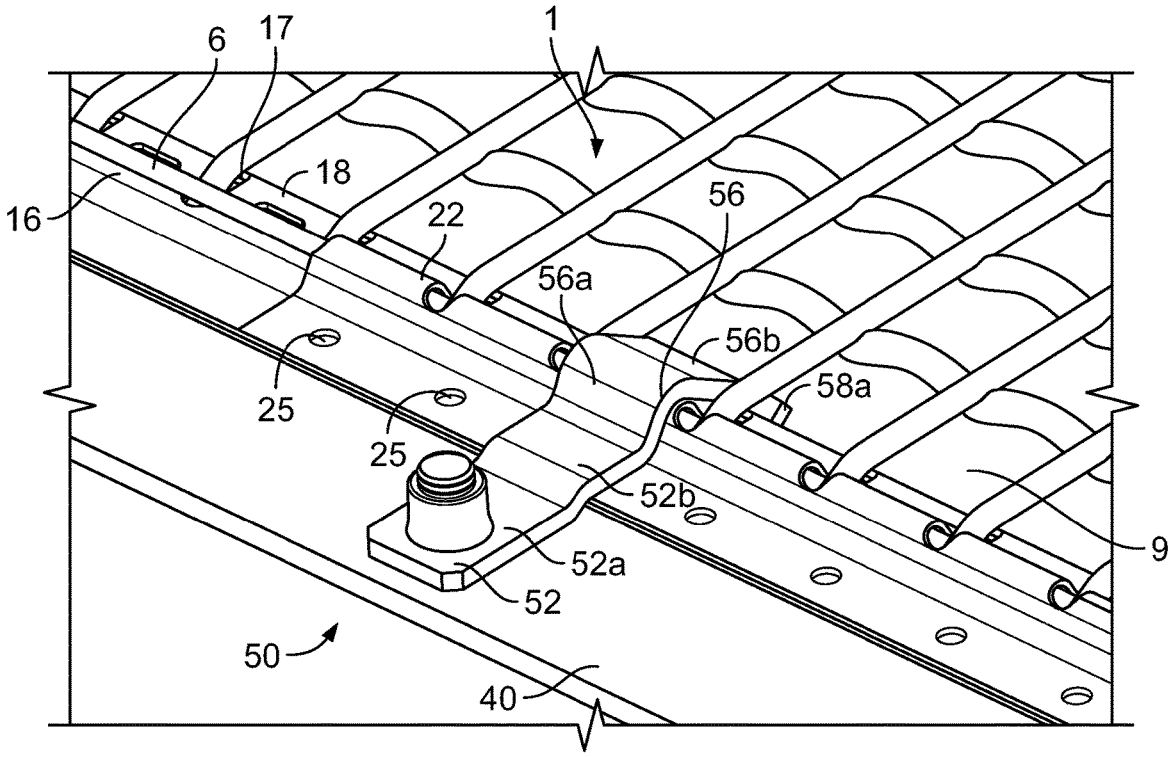
FIG. 5C is an alternative orthographic view of the anti-theft device in FIG. 5A.
Figure 5D:
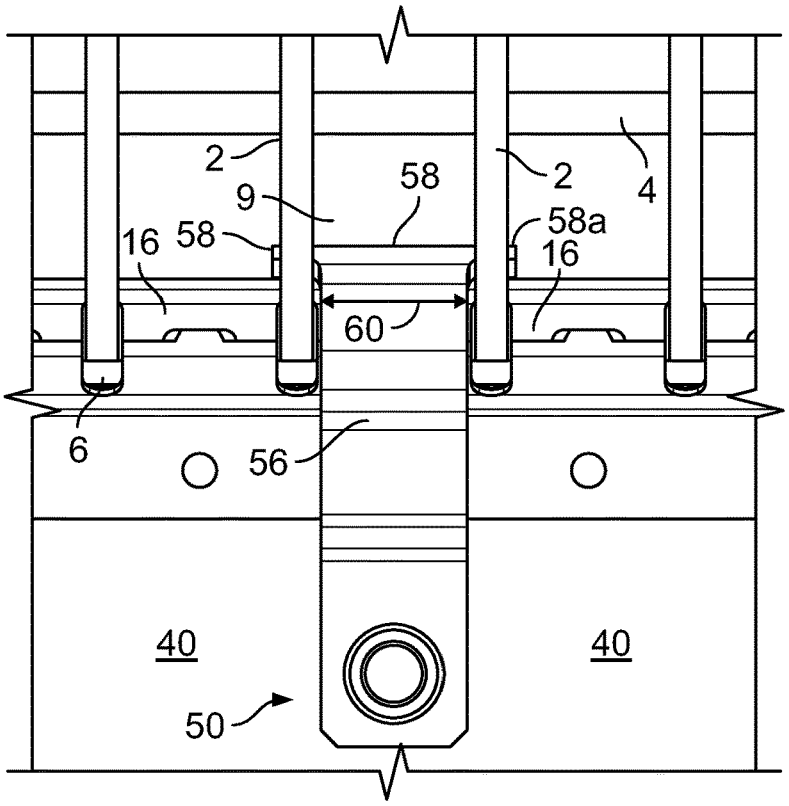
FIG. 5D is a top view of the anti-theft device of FIG. 5A.

In a preferred embodiment, anti-theft device arched cover 56 is sized and shaped to extend beyond the end of hinge connector 8—e.g., the anti-theft device cover may have an end 58 that extends beyond the end 16*a* of platform 16 of the hinge connector. End 58 of overhinge anti-theft device 50 may be further configured to engage or couple to grating panel 1 to increase the difficulty in removing the anti-theft device. In one embodiment, end 58 of anti-theft device arched cover 56 is sized and shaped to fit within openings 9 formed in grating panel 1. As shown in FIG. 5A and FIG. 5D, anti-theft device arched cover 56 may have a width 60 that is about the same size or slightly smaller than openings 9 of grating panel 1, to allow end 58 to project through an opening 9 in grating 1 and extend below rods 2. End 58 engages grating panel 1 by one or more tabs or flanges 58*a* that project transversely below rods 2, such that flanges 58*a* have a width greater than the size of openings 9. When force is applied to lift overhinge anti-theft device 50 from grating panel 1, flanges 58*a* engage rods 2 to prevent removal of the anti-theft device from the grating.

One or more anti-theft devices 50 are positioned on hinge connector 8, spaced apart along the length of the hinge connector 8 and/or grating panel 1. In a preferred embodiment, at least two anti-theft devices 50 are positioned near each end of the length of hinge connector 8 and/or grating panel 1. Additional anti-theft devices 50 may be positioned along the length of hinge connector 8 and/or grating panel 1 therebetween for increased security. Each overhinge anti-theft device 50 is secured to railcar deck surface 40 by a fastener 53. An opening 51 is formed in first end 52*a* of overhinge anti-theft device 50, that is sized and shaped to receive fastener 53 and secure the anti-theft device to railcar deck surface 40. Fastener 53 may be any of a variety of fasteners known in the art, including screws, rivets and bolts. Because a relatively small number of fasteners 53 are required to secure grating panel 1, fastener 53 may be larger, made of more durable material and/or have a more secure design, that might otherwise be prohibitively expensive for use as a hinge connector fastener. In one embodiment, fastener 53 is a blind oversized mechanically locked fastener having a collar 55 and head 57, such as a Huck BOM® (Alcoa Fastening Systems & Rings—Waco, Tex.). In another embodiment (not shown), the fastener 53 includes a head and a shank that extends from the head to the endpoint of the fastener 53. In this embodiment, the opening 51 in the first end 52*a* of overhinge anti-theft device 50 is sized and shaped to receive the shank of the fastener 53 but not the head of fastener 53.

In operation, hinge connector 8 is positioned on railcar deck surface 40 with hinge bar 6 of grating panel 1 enclosed between hinge keeper 20 and hinge base 10. Overhinge anti-theft device 50 is positioned over hinge connector 8 with anti-theft device seat 54 positioned on railcar deck surface 40 and anti-theft device arched cover 56 extending over hinge connector 8. End 58 of anti-theft device arched cover 56 passes through an opening 9 of grating panel 1 with flanges 58*a* extending transversely below rods 2 of the grating. First end 52*a* of overhinge anti-theft device 50 is secured to railcar deck surface 40 by a fastener 53 received in opening 51. Second end 52*b* of overhinge anti-theft device 50 is secured under grating panel 1 by flanges 58*a* of anti-theft device arched cover 56. Additional fasteners may be received in openings 25 of hinge connector 8 to further secure the hinge connector to railcar deck surface 40.

To remove grating panel 1, fasteners 53 must be removed from the multiple anti-theft devices 50 that are positioned along the length of hinge connector 8 and/or grating panel 1. Hinge connector 8 also must be dissembled to release hinge bar 6 and free grating panel 1 from a transport railcar deck surface 40. The additional time and difficulty in removing numerous larger fasteners 53 to free grating panel 1 from anti-theft devices 50 creates a substantial deterrent to theft.

Figure 6A:
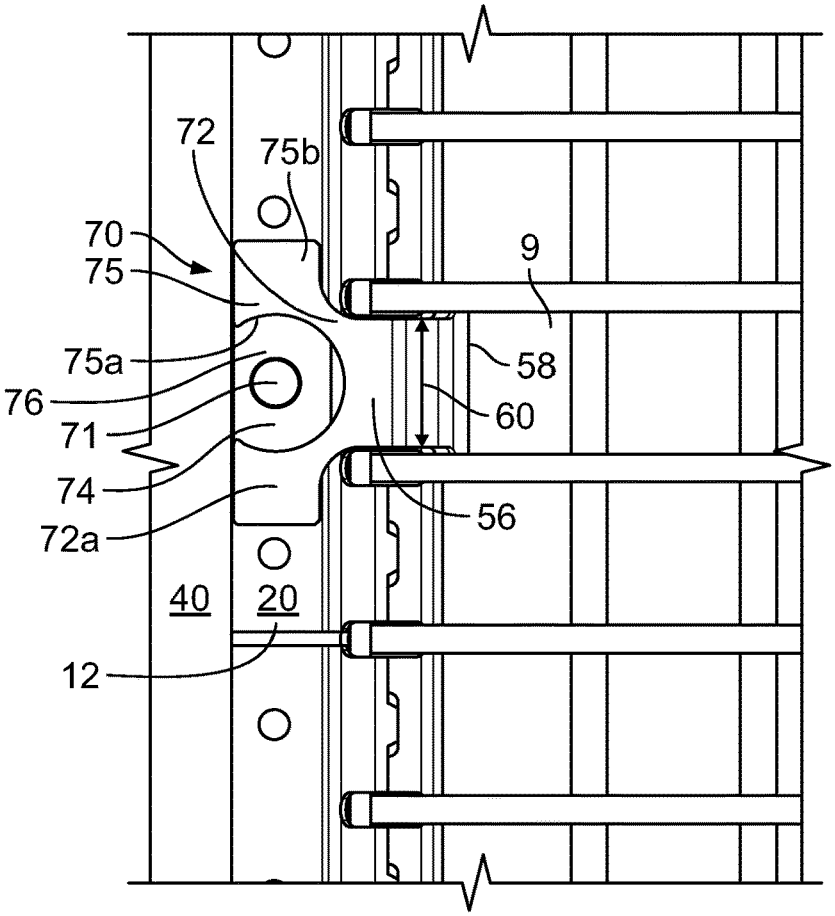
FIG. 6A is a top view of an alternative embodiment of an anti-theft device coupled to the grating connector and grating of FIG. 2.
Figure 6B:
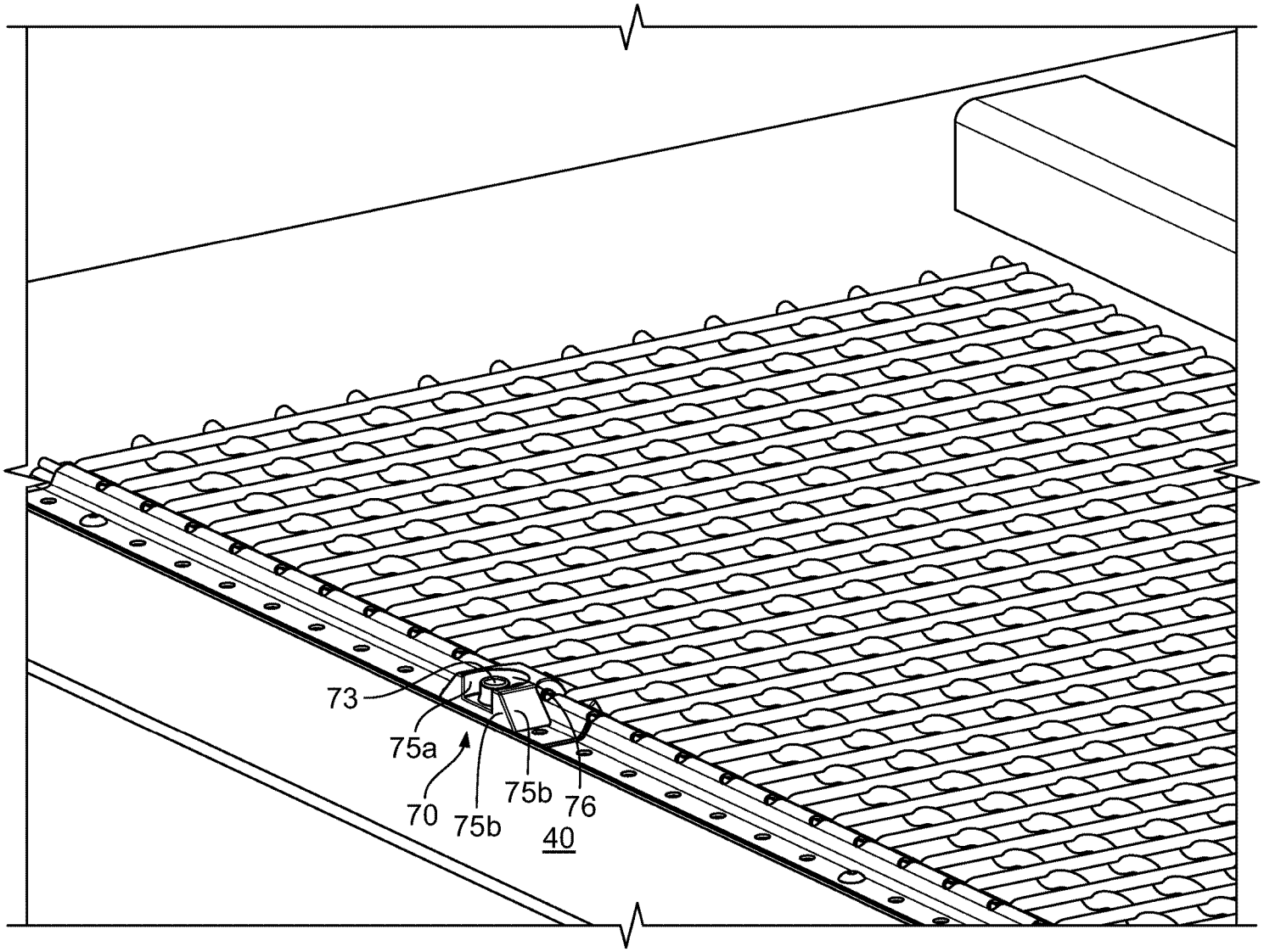
FIG. 6B is an orthographic view of the anti-theft device of FIG. 6A.

Referring to FIGS. 6A and 6B, an alternative embodiment of an anti-theft device is shown that combines the features of the cup-block and overhinge devices. The length of overhinge anti-theft device 70 may be decreased such that the first end 72*a* of the body 72 is positioned on top of the keeper seat 20 of the hinge keeper 12. In this embodiment, the fastener 73 of the overhinge anti-theft device 70 is received by the opening 71 of the overhinge anti-theft device 70 first end 72*a* and the opening 25 formed in hinge keeper 12. The opening 25 in hinge keeper 12 may be already formed in hinge keeper 12. It will be understood that the fastener 73 of overhinge anti-theft device 70 may be larger than the openings 25 in the hinge keeper 12. Accordingly, these openings 25 may need to be enlarged using various means known in the art, such as a drill. In one embodiment, no portion of the first end 72*a* of the body 72 of the overhinge anti-theft device 70 extends onto the transport railcar deck surface 40. In other words, the entirety of the first end 72*a* of the body 72 of the overhinge anti-theft device 70 is disposed on top of hinge keeper 12. In another embodiment, the fastener 73 includes a head and a shank that extends from the head to the endpoint of the fastener 73. In this embodiment, the opening 71 in the first end 72*a* and the opening 25 in the hinge keeper 12 are sized and shaped to receive the shank but not the head.

The first end 72*a* of the body 72 may further include a cup comprising a base 74 and wall 75 that extends upwardly from the transport railcar surface 40 and/or the keeper seat 20. The base 74 and wall 75 form an interior cavity 76. The wall 75 includes an inner surface 75*a* and an outer surface 75*b*. The outer surface 75*b* can include a plurality of sides disposed at various angles to the keeper seat 20. For example, in the embodiment depicted in FIGS. 6A-6B, two of these outer surfaces 75*b* are disposed at an angle oblique to the keeper seat 20. One of the purposes of forming these outer surfaces 75*b* at a non-right angle is to form an outer surface 75*b* that will deflect impact, as described with respect to FIGS. 4A-4E. A third outer surface 75*b* of the embodiment depicted in FIGS. 6A-6B is disposed at a right angle and is partially cut-out and forms an opening in the wall 75 of the cup. This opening provides additional space for any tools necessary to install the fastener 73 without unnecessarily enlarging the overhinge anti-theft device 70. That is, the entirety of the top portion of the outer surface 75*b* does not extend to the same height. The inner surface 75*a* is formed to at least partially surround the opening 71 of the overhinge anti-theft device 70. The opening 71 of the overhinge anti-theft device 70 is formed in the base 74. Further, the inner surface 75*a* is formed to extend at least as high as the topmost portion of the fastener 73 once the fastener 73 has been installed. As depicted in FIGS. 6A-6B, the inner surface 75*a* only partially encloses the opening 71, however, the inner surface may also be designed to fully enclose the opening 71 in an annular or other shape. The wall 75 may be sized and shaped to receive a plate (not shown), similar to the embodiment depicted in FIGS. 3A-3D and 4A-4E.

The remainder of overhinge anti-theft device 70 depicted in FIGS. 6A-6B is substantially similar to the overhinge anti-theft device 50 depicted in FIGS. 5A-5D. Namely, with respect to the formation of the second end 56*b* of the overhinge anti-theft device 50 to extend over the hinge connector 8 (conforming its shape thereto) and then extending through the openings 9 of grating panel 1.

It will be understood that the embodiments depicted in FIGS. 5A-5D and/or FIGS. 6A-6B may both be designed to incorporate cup-block anti-theft device 26 (depicted in FIGS. 3A-3D and/or 4A-4E) such that the fasteners 53, 73 of overhinge anti-theft devices 50, 70 have further protection, including, by incorporation of the plate.

Although the invention has been described in detail with reference to preferred embodiments, variations and modifications exist within the scope and spirit of the invention as described and defined in the following claims.

What is claimed is:

1. An anti-theft device for a grating of a transport railcar, the grating coupled to a surface of the railcar by a grating connector and a fastener having a head and a shank, the anti-theft device comprising:

a cup including a base and a wall that define a cavity, the base having a first opening that is sized and shaped to receive the shank of the fastener and retain the head within the cavity, the wall having an outer surface including at least one side forming an obtuse angle relative to the railcar surface, wherein the obtuse angle faces away from the outer surface; and a plate;

wherein the cup is positioned on the grating connector and the base conforms to the shape of the grating connector, and wherein the wall has a rim defining a second opening into the cavity, the second opening sized and shaped to receive the plate, and the cavity sized and shaped to contain the plate and fastener head when the plate is fully inserted through the second opening.

2. The anti-theft device of claim 1, wherein the plate is disk shaped and the rim is circular.

3. The anti-theft device of claim 1, wherein the rim is sized and shaped to receive the plate by snap fit insertion into the cavity.

4. The anti-theft device of claim 1, wherein the rim has a lip and the plate has a side extending around the perimeter of the plate;

the lip and the side are substantially the same shape and at least a portion of the side is slightly larger than the lip; and wherein the lip can flex to receive the plate.

5. An anti-theft device for a transport railcar grating of a transport railcar, the grating including a plurality of transversely coupled rods that form a plurality of grating openings therebetween, the grating coupled to a surface of the railcar by a grating connector, the anti-theft device comprising:

a fastener; and a body extending over the grating connector, the body comprising:

a first end coupled to the railcar surface by the fastener, the first end including a base and a wall that define a cavity, the base including a first opening sized and shaped to receive the fastener, the wall having an outer surface including at least one side that forms an obtuse angle relative to the railcar surface; and a second end that projects through a grating opening and including a flange extending transversely to a rod forming the grating opening.

6. An anti-theft device for a grating of a transport railcar, the grating including a plurality of transversely coupled rods that form a plurality of grating openings therebetween, a grating connector coupled to the railcar and having an end coupled to the grating, the anti-theft device comprising:

a fastener; and a body extending over the grating connector, the body comprising:

a first end coupled to the railcar surface by the fastener, the first end including a base and a wall that define a cavity, the base including a first opening sized and shaped to receive the fastener; and a second end that extends beyond the end of the grating connector and that projects through a grating opening, the second end including a flange extending transversely to a rod forming the grating opening.

7. The anti-theft device of claim 6, wherein the fastener comprises a head and a shank, and the first opening is sized and shaped to receive the shank and retain the head within the cavity.

8. The anti-theft device of claim 6, wherein the first end of the body is positioned on the grating connector, and the first end of the body and the grating connector are coupled to the railcar surface by the fastener.

* * * * *